US006296179B1

(12) United States Patent
Wortman

(10) Patent No.: US 6,296,179 B1
(45) Date of Patent: Oct. 2, 2001

(54) INSIDE OUT TWO-WAY SHIPPING ENVELOPE

(76) Inventor: Elizabeth Wortman, 272 Gallery La., Mount Bethel, PA (US) 18343

( * ) Notice: Subject to any disclaimer, the term of this patent is extended or adjusted under 35 U.S.C. 154(b) by 0 days.

(21) Appl. No.: 09/694,648

(22) Filed: Oct. 23, 2000

(51) Int. Cl.[7] ..... B65D 27/06; B65D 27/34
(52) U.S. Cl. ..... 229/306; 229/313
(58) Field of Search ..... 229/301, 306, 229/313

(56) References Cited

U.S. PATENT DOCUMENTS

| | | |
|---|---|---|
| 41,804 | 3/1864 | Woolworth . |
| 321,297 | 6/1885 | Hoffmann . |
| 1,206,417 | 11/1916 | Cunkle . |
| 4,046,311 | 9/1977 | Voytko . |
| 4,535,929 | 8/1985 | Sherman, II et al. . |
| 4,560,102 | 12/1985 | Dlugolpolski . |
| 4,867,372 | 9/1989 | Patterson . |
| 5,025,980 | 6/1991 | Blackman . |
| 5,826,787 | 10/1998 | Turner . |
| 5,934,549 | 8/1999 | Baumgartner . |

*Primary Examiner*—Jes F. Pascua
(74) *Attorney, Agent, or Firm*—John V. Stewart

(57) ABSTRACT

A shipping envelope having an outer surface, an inner surface, a closure flap with first and second adhesive strips and on opposite surfaces of the flap, and a perforation between the adhesive strips. The first adhesive strip is nearest the outer edge of the flap, and is used to close and seal the envelope for the first time. The recipient opens the envelope along the perforation. If return shipping is desired, the recipient turns the envelope inside out, exposing a second shipping label. The second adhesive strip is now in position to close and seal the flap for a second shipment, such as a return shipment for refund or exchange.

3 Claims, 3 Drawing Sheets

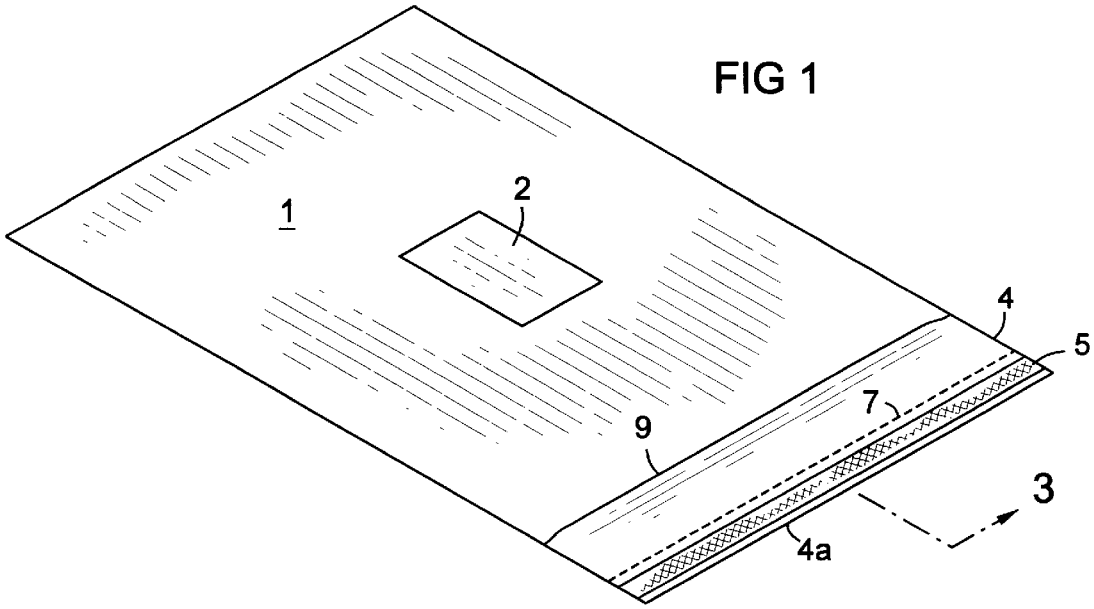
FIG 1
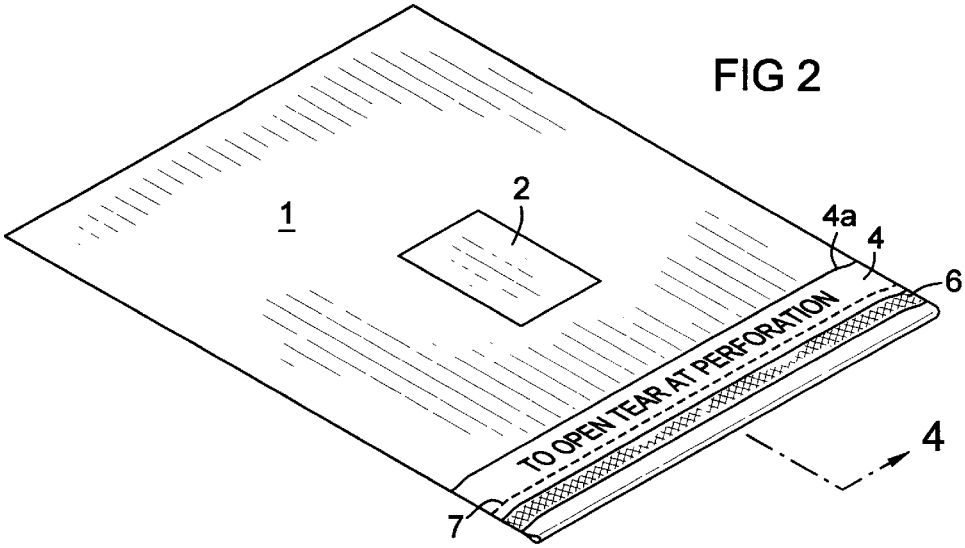
FIG 2
FIG 3
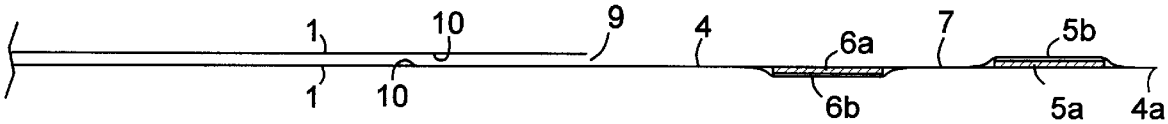
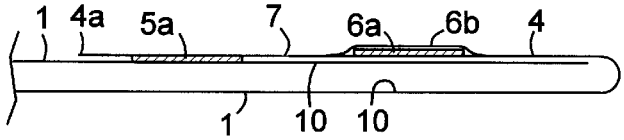
FIG 4

INSIDE OUT TWO-WAY SHIPPING ENVELOPE

BACKGROUND OF THE INVENTION

1. Field of the Invention

This invention relates to shipping bags or envelopes that have special features enabling reuse for return shipping.

2. Description of Prior Art

Shippers of merchandise often have a policy for return shipping of defective or unsatisfactory merchandise. Often the original shipping carton or envelope is reused for return shipping. However, the customer must create and/or paste a return shipping label over the original shipping label, and may need to cover marks on the carton or envelope made by the courier or postal service indicating the courier being used or cancellation of postage.

Prior shipping containers and envelopes were found that provide features for re-use for return shipping. However, none of them provide the simplicity, practicality, and advantages of the present invention. Only Patterson uses an inside out design concept, but uses it differently as described below. A list of other examples follows.

U.S. Pat. No. 4,867,372 Patterson 1989. This shows a box that is reversible by turning it inside out. However, it must be disassembled and reassembled to do so. This requires that all the adhesive strips are releasable (non-permanent), making the box sealing less secure. Also, this design results in active adhesive on the outside of the box in the return configuration. The user must cover this active external adhesive with tape to prevent it from sticking to other envelopes in transit.

| | | |
|---|---|---|
| U.S. Pat. No. 41,804 | Woolworth | 1864 |
| U.S. Pat. No. 321,297 | Hopmann | 1885 |
| U.S. Pat. No. 1,206,417 | Cunkle | 1916 |
| U.S. Pat. No. 4,046,311 | Voytko | 1977 |
| U.S. Pat. No. 4,535,929 | Sherman | 1985 |
| U.S. Pat. No. 4,560,102 | Dlugopolski | 1985 |
| U.S. Pat. No. 5,025,980 | Blackman | 1991 |
| U.S. Pat. No. 5,826,787 | Turner | 1998 |
| U.S. Pat. No. 5,934,549 | Baumgartner | 1999 |

SUMMARY OF THE INVENTION

The objective of the present invention is provision of a shipping bag or envelope that can be reused by the recipient for return shipping with minimal effort, using a preprinted return address or preprinted shipping label to eliminate shipping errors. A further objective is a shipping envelope that provides a fresh outer surface for return shipping without postage marks, courier identification, or other marks used in the original shipping.

The objectives of the present invention are achieved in a shipping envelope having an outer surface 1, an inner surface 10, a closure flap 4 with first and second adhesive strips 5 and 6 on opposite surfaces of the flap, and a perforation 7 between the adhesive strips. The first adhesive strip is nearest the edge of the flap, and is used to close and seal the envelope for the first time. The recipient opens the envelope along the perforation. If return shipping is desired, the recipient turns the envelope inside out, exposing a preprinted return-address shipping label 3. The second adhesive strip is now in position to close and seal the flap for a second shipment, such as a return shipment for refund or exchange.

BRIEF DESCRIPTION OF THE DRAWINGS

FIG. 1 is a top view of a shipping envelope according to the invention prior to first use.

FIG. 2 is the envelope of FIG. 1 sealed for first shipping.

FIG. 3 is a partial sectional view taken along line 3 of FIG. 1.

FIG. 4 is a partial sectional view taken along line 4 of FIG. 2.

REFERENCE NUMBERS

Figure 5:
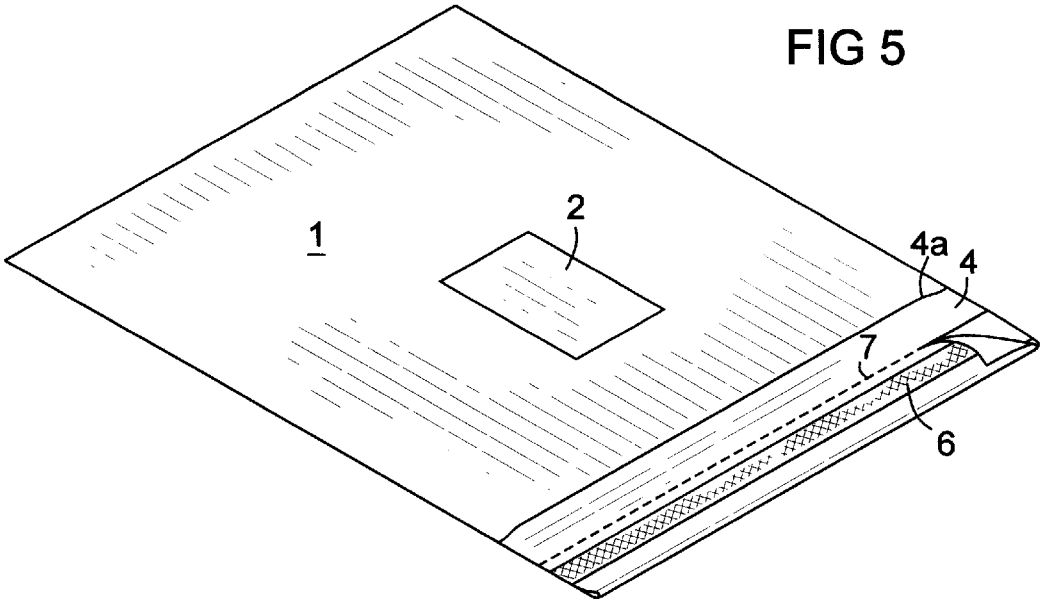
FIG. 5 is the envelope of FIG. 2 as the first recipient opens it.

1. Outer surface of shipping bag or envelope
2. First address label
3. Second address label
4. Closure flap
4*a*. Outer edge of closure flap
5. Covered first adhesive strip
5*a*. First adhesive strip
5*b*. Removable protective cover tape on first adhesive strip
6. Covered second adhesive strip
6*a*. Second adhesive strip
6*b*. Removable protective cover tape on second adhesive strip
7. Perforation
7*a*. First edge resulting from tearing perforation
7*b*. Second edge resulting from tearing perforation
9. Opening of envelope
10. Inner surface of shipping bag or envelope

DETAILED DESCRIPTION

FIGS. 1 and 3 show a shipping envelope having an outer surface 1, an inner surface 10, an opening 9, a flap 4 adjacent to the opening for closing the envelope, and a first adhesive strip 5 on the flap for sealing the flap in the closed position. The first adhesive strip can optionally be located on the upper surface of the envelope in the overlap zone of the outer edge 4*a* of the folded flap. However, it is preferable to locate the first strip on the flap, since the flap will overlap differently depending on the volume of contents in the envelope. The adhesive strip preferably is a ready adhesive with a protective covering tape. A user removes the protective tape, and folds the flap against the upper surface of the envelope, as shown in FIGS. 2 and 4.

A first address label 2 is provided on the exterior of the envelope. It preferably shows the address of the recipient and the return address of the shipper. Optionally, the address and return address can be written directly on the exterior of the envelope.

The flap 4 has second adhesive strip 6 on the opposite side of the flap from the first strip 5. The first strip 5 is closer to the outer edge 4*a* of the flap than is the second strip 6. Between the first and second adhesive strips is a perforation line 7 in the flap.

Figure 6:
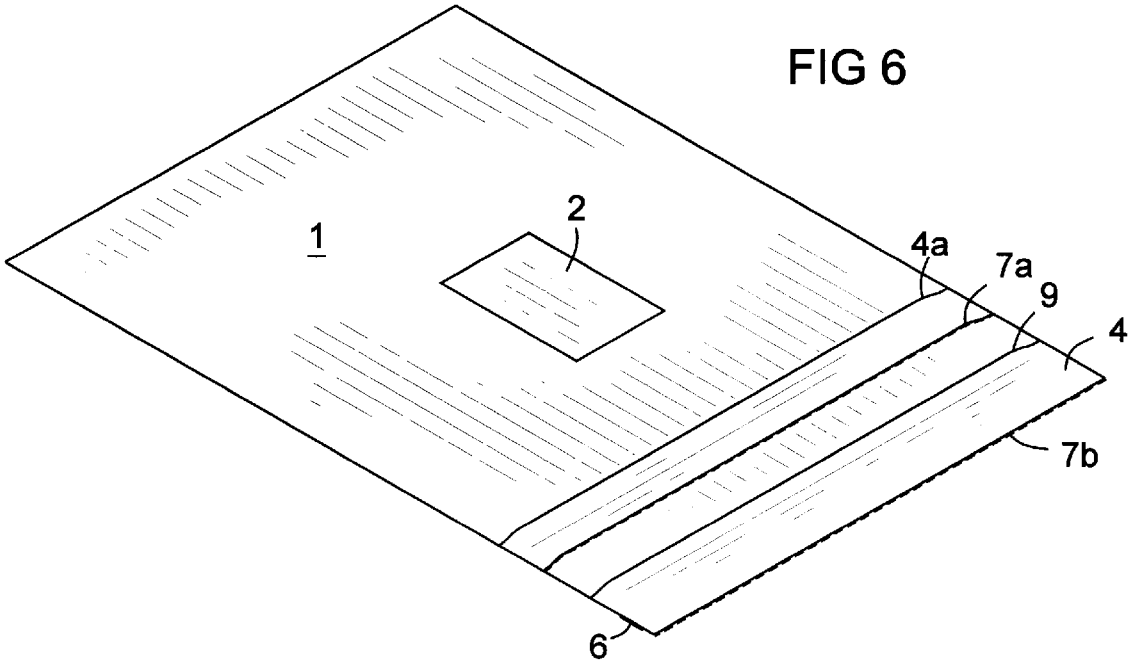
FIG. 6 is the envelope of FIG. 5 after opening by the first recipient.

The recipient opens the envelope by tearing the flap along the perforation line, as in FIG. 5. This results in an open envelope as in FIG. 6, from which the recipient can remove the contents.

Figure 7:
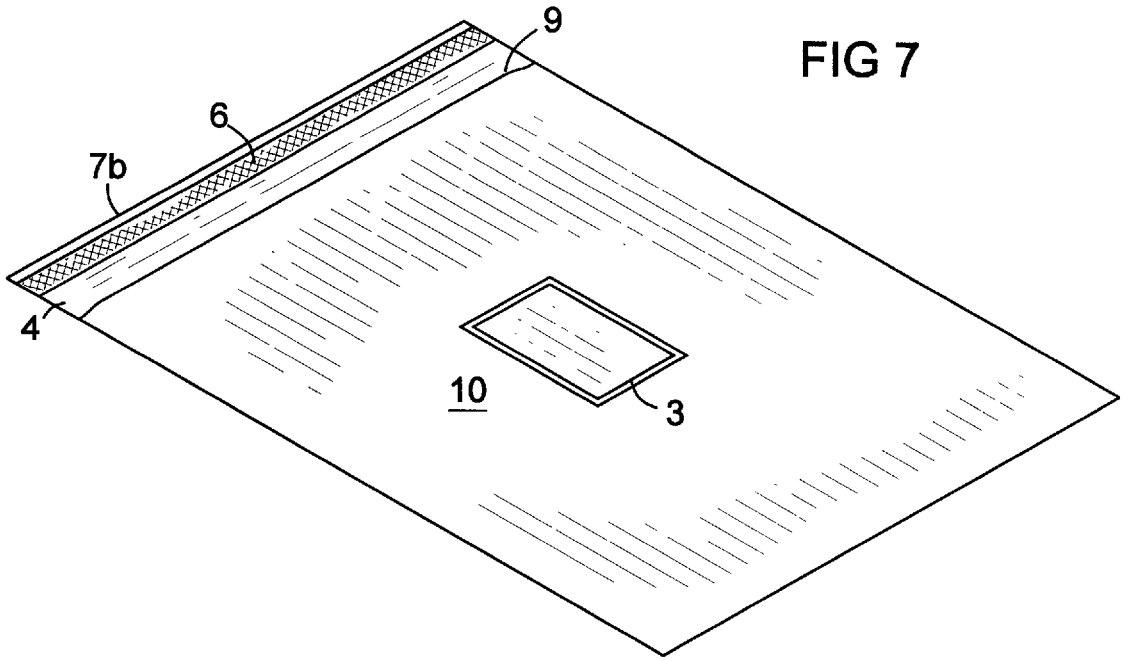
FIG. 7 is the envelope of FIG. 6 after being reversed inside out.
Figure 8:
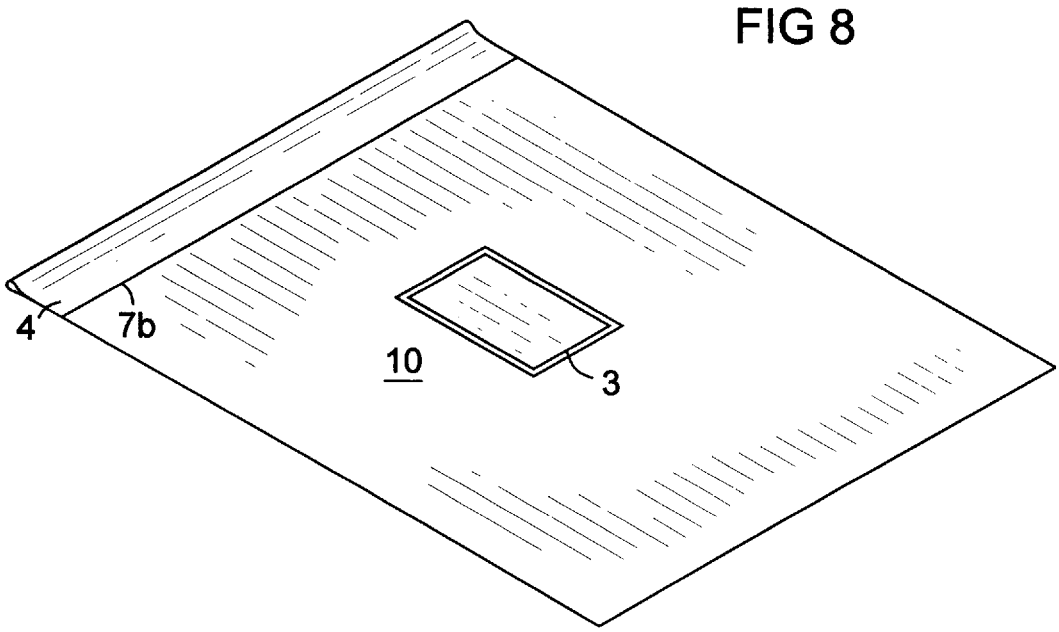
FIG. 8 is the envelope of FIG. 7 sealed for second shipping.

The envelope has a preprinted address or preprinted address label on an interior surface 10 of the envelope. This second shipping label preferably has the return address of the shipper pre-printed, and optionally may have return postage pre-printed. If the recipient wants to return a shipment, he/she simply inverts the envelope inside out as in FIG. 7. Now the second shipping label 3 is on the outside of the envelope, and the second adhesive strip 6 is in position to seal the remaining portion of the flap 4 against the now outer surface 10 of the envelop as in FIG. 8. This allows the recipient easily and accurately to return a shipment using the same envelope for a refund, exchange, or repair, per the policy of the shipper.

Optionally, the second shipping label may have the address of a third destination, such as the shipper's customer service department.

Although the present invention has been described herein with respect to preferred embodiments, it will be understood that the foregoing description is intended to be illustrative, not restrictive. Modifications of the present invention will occur to those skilled in the art. All such modifications that fall within the scope of the appended claims are intended to be within the scope and spirit of the present invention.

I claim:

1. A reusable shipping container comprising:

a front panel and a back panel, each panel having left, right, bottom, and top edges;

the front and back panels permanently sealed together along respective left, right, and bottom edges only, forming an envelope with an opening between the top edges of the front and back panels;

the envelope having an inner surface and an outer surface;

a first address label on the outer surface of the envelope;

a second address label on the inner surface of the envelope;

a closure flap having a first edge attached to the envelope at a fold line along one of the top edges of the first and second panels forming the opening, the flap having a free second edge distal to the first edge, a first surface facing the opening, and a second surface facing away from the opening;

first and second adhesive strips on the first and second surfaces of the flap respectively, the first adhesive strip adjacent to the second edge of the flap; and a perforation in the flap between the adhesive strips;

whereby the envelope can be closed with the flap using the first adhesive strip, shipped to the first address; opened by tearing along the perforation line, and reused by turning the envelope inside out, sealing the envelope with the second adhesive strip, and shipping the envelope to the second address.

2. A shipping envelope, comprising:

a permanently enclosed portion having an interior and an exterior;

an opening into the enclosed portion;

a flap adjacent to the opening, the flap having a first surface facing the opening, a second surface opposite the first surface, and a distal edge;

a first adhesive strip on the first surface of the flap adjacent the distal edge of the flap;

a second adhesive strip on the second surface of the flap;

a perforation line in the flap between the first and second adhesive strips;

a first address on the exterior of the envelope; and a second address on the interior of the envelope;

whereby the envelope can be closed with the flap using the first adhesive strip, shipped to the first address; opened by tearing along the perforation line, and reused by turning the envelope inside out, sealing the envelope with the second adhesive strip, and shipping the envelope to the second address.

3. A method of return shipping of contents in a reusable shipping envelope, comprising the steps of:

a) receiving a shipping envelope with a permanently enclosed portion having an inner surface, an outer surface, and an opening, a first address label on the outer surface, a second address label on the inner surface, a closure flap adjacent the opening with first and second opposite surfaces and an outer edge, the first surface of the flap facing the opening, first and second adhesive strips on the first and second surfaces of the flap respectively, the first adhesive strip adjacent the outer edge of the flap, a perforation in the flap between the adhesive strips, the flap folded over the opening, and sealed against the outer surface of the envelope with the first adhesive strip;

b) opening the envelope by separating the perforation;

c) removing the contents of the envelope;

d) turning the envelope inside out;

e) inserting the contents in the inside out envelope;

f) closing the envelope by folding the flap over the opening and sealing it with the second adhesive strip; and g) shipping the envelope using the second address label.

* * * * *